United States Patent [19]

Gresens et al.

[11] 4,231,165

[45] Nov. 4, 1980

[54] PROCESS FOR HEAT-TREATING A FABRIC WEB

[75] Inventors: Harry Gresens, Benningen; Manfred Schuierer, Michelstadt, both of Fed. Rep. of Germany

[73] Assignee: Bruckner Apparatebau GmbH, Erbach, Fed. Rep. of Germany

[21] Appl. No.: 914,532

[22] Filed: Jun. 12, 1978

[30] Foreign Application Priority Data

Jun. 22, 1977 [DE] Fed. Rep. of Germany ..... 2727971
Mar. 23, 1978 [DE] Fed. Rep. of Germany ..... 2812966

[51] Int. Cl.[3] ..... F26B 3/04

[52] U.S. Cl. ..... 34/28; 34/32; 34/35; 34/86; 34/212; 34/216; 68/18 R; 432/72

[58] Field of Search ..... 34/28, 32, 35, 86, 212, 34/213, 216; 68/18 C, 18 R; 432/72

[56] References Cited

U.S. PATENT DOCUMENTS

| | | | |
|---|---|---|---|
| 3,437,321 | 4/1969 | Wilkinson | 432/72 |
| 3,875,678 | 4/1975 | Vits | 34/32 |
| 3,936,951 | 2/1976 | Haueise et al. | 34/86 |
| 3,942,264 | 3/1976 | Zenkner | 34/86 |
| 4,092,100 | 5/1978 | Phillips | 432/72 |
| 4,115,052 | 9/1978 | Flynn | 34/35 |
| 4,132,011 | 1/1979 | Nichols | 34/86 |
| 4,133,636 | 1/1979 | Flynn | 34/35 |

FOREIGN PATENT DOCUMENTS 2063444 7/1972 Fed. Rep. of Germany .

*Primary Examiner*—Larry I. Schwartz
*Attorney, Agent, or Firm*—Learman & McCulloch

[57] ABSTRACT

A process for heat-treating and, in particular, for drying and/or fixing a continuously moved fabric web in a treatment unit comprising at least two treatment zones through which the fabric web successively passes, using a hot gas stream recirculated in the treatment unit, a certain quantity of waste gas being continuously removed from the treatment unit and freed from constituents present in it and some of the waste gas thus treated being returned to the treatment unit after reheating, the rest of the waste gas being released into the atmosphere.

7 Claims, 2 Drawing Figures

PROCESS FOR HEAT-TREATING A FABRIC WEB

BACKGROUND OF THE INVENTION

In conventional processes for heat treating and, in particular, for drying and/or fixing continuously moved fabric webs (for example in so-called tenter frames), the quantity of waste air accumulating amounts to around 10 cubic meters per kg of fabric. The quantity of waste air accumulating during drying depends upon the extent to which the air is saturated with water (an enrichment of the air with at most 100 g of water per cubic meter of air is normally selected for drying). The quantity of waste air which accumulates during heat-fixing is determined by the organic substance content of the air.

The large quantities of waste air referred to above are extremely undesirable for a number of reasons. Not only do they represent a considerable loss of heat, they also give rise to considerable problems if the recently prescribed maximum pollutant content of the waste air is not to be exceeded.

In one known process of the type referred to above (DT-OS No. 2,063,444), the quantity of waste gas continuously removed from the treatment unit is initially freed from condensible constituents present in it. Some of this waste gas is then returned to the treatment unit after reheating, whilst the rest of the waste gas is released into the atmosphere. Accordingly, this known process is essentially a means of pretreating the waste air of which the efficiency is largely dependent upon the boiling properties of the constituents to be removed (for example organic solvents) and upon the waste-air outlet temperature reached in the condenser. Disadvantages of this process include its poor thermal efficiency and, above all, the content of noncondensible or non-condensed polluting constituents in the proportion of waste gas released into the atmosphere.

In another known process for the heat treatment of waste air ("Textilprasix International" 1976, page 281), the pollutant-containing waste air from a textile treatment unit is delivered to a combustion chamber and is heated to a reaction temperature of around 750° C. by admixture with the waste gases from an oil or gas burner. In this way, the hydrocarbons burn to form steam and carbon dioxide. In this connection, attempts have already been made to recover a certain amount of heat, for example by heating the impure waste air with the purified waste air in a heat exchanger preceding the combustion unit. However, close examination of the heat balance and the necessary investment costs has shown that the technical outlay involved in this known thermal waste-air treatment process is still uneconomically high.

Accordingly, the object of present invention is to obviate the disadvantages of conventional processes by providing a process of the type referred to above which considerably reduces the amount of waste gas released into the atmosphere in a particularly economical manner.

SUMMARY OF THE INVENTION

According to the invention, this object is achieved in that the entire quantity of waste gas is removed in the form of two component waste-gas streams from separate treatment zones, the first component waste-gas stream removed from a treatment zone through which the fabric web initially passes being returned to the treatment unit following the removal of condensible constituents present in it, whilst the second component waste-gas stream removed from a treatment zone through which the fabric web subsequently travels is freed from the polluting constituents present in it by combustion and is used for reheating the first component waste-gas stream before being released into the atmosphere.

By virtue of the fact that, in the process according to the invention, the entire quantity of waste gas is removed in the form of two component waste-gas streams from separate treatment zones through which the fabric web successively passes, it is possible to ensure that the first component waste-gas stream contains condensible polluting constituents in large measure, whilst the non-condensible polluting constituents or the polluting constituents which are best not condensed are predominantly contained in the second component waste-gas stream which is removed from a treatment zone through which the fabric web subsequently passes (for example in a treatment unit provided with drying chambers and fixing chambers, the first component waste-gas stream may be removed from a drying chamber and the second component waste-gas stream from a fixing chamber). According to the invention, these two component waste gas streams are then respectively subjected to a treatment optimally adapted to each of them. The condensible constituents present in the first component waste gas stream are removed by condensation, whilst the non-condensible polluting constituents or the polluting constituents best not condensed which are primarily present in the second component gas stream are eliminated by combustion.

In the process according to the invention, the heat content of the second component waste gas stream purified by post-combustion is largely recovered in that, before being returned to the treatment unit, the first component waste gas stream cooled to condense the condensible constituents is reheated with the second component waste gas stream which has been subjected to post-combustion.

As extensive tests have shown, the quantity of waste gas released into the atmosphere can be reduced to at least one third of the present level by virtue of the process according to the invention. This affords considerable advantages in regard to the necessary treatment of this greatly reduced quantity of waste gas and provides for a considerable improvement in thermal efficiency.

In one preferred embodiment of the process according to the invention, the second component waste gas stream heated by combustion is used first for preheating the second component waste gas stream delivered to the combustion unit and then for reheating the first component waste gas stream.

The second component waste gas stream delivered to the combustion unit may be preheated for example to a temperature of at least about 400° C. and preferably to a temperature of around 450° C. In this way, the combustion unit is able to manage with very small quantities of energy for reaching the reaction temperature required for burning the pollutants (in the range from about 700° to 750° C.).

IN THE DRAWINGS

Figure 1:
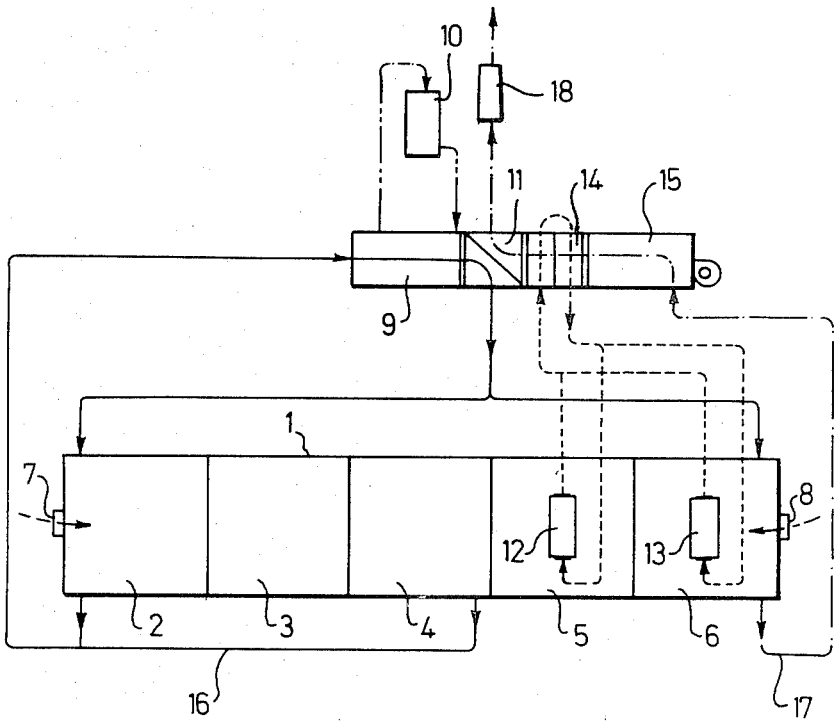
FIG. 1 is a schematic diagram of one form of installation for performing the process of the present invention.

The embodiment shown diagrammatically in FIG. 1 comprises a tenter frame 1 with three treatment chambers 2, 3 and 4 for drying a fabric web (not shown) and two treatment chambers 5 and 6 for fixing the fabric web. The fabric web, held by tension chains, is introduced into the tenter frame through an inlet opening 7 and guided out through an outlet opening 8 at the other end.

The installation further comprises a condenser 9 which is connected to a cooling tower 10 used for recooling the cooling water.

The installation further comprises a heat exchanger 11, another heat exchanger 14 connected to air heaters 12, 13 and a combustion chamber 15.

A first component waste gas stream 16 is removed from the chambers 2 to 4 of the tenter frame 1. The steam present in it is condensed in the condenser 9. This first component waste gas stream 16 is then reheated in the heat exchanger 11, after which it passes back into the tenter frame 1.

A second component waste gas stream 17 is removed from the chambers 5 and 6 and delivered to the combustion chamber 15. The pollutants (particularly organic substances which evaporate from the fabric web in the fixing zone) present in the second component waste gas stream 17 are burnt in this combustion chamber 15 which is heated by a burner. The waste gases from the combustion chamber 15 initially pass through the heat exchanger 14 where they heat a gaseous or liquid heat carrier (for example a thermal oil) which is then delivered to the air heaters 12 and 13 where it heats the hot air recirculated in the tenter frame 1.

The second component waste gas stream 17 then passes through the heat exchanger 11 where, as already mentioned, it heats the first component waste gas stream 16 returned to the tenter frame 1. The second component waste gas stream 17 is then released into the atmosphere at 18.

The advantages afforded by the process according to the invention are illustrated by way of example in the following description of one possible method of operating the installation shown in FIG. 1.

The fabric web to be treated consists of a mixture of 55% of wool and 45% of polyester. It weighs 500 g per square meter and has a working width of 2 meters (which gives a fabric throughput of 780 kg/hour).

If the quantity of water to be evaporated is assumed to amount to 50% of the weight of the fabric, this corresponds to 250 g of $H_2O/m^2$ or 390 kg/h. Taking into account the above mentioned saturation level of 100 g of water per cubic meter of waste air, this means that the waste air must accumulate in a quantity of from 3900 to 4000 $m^3/h$.

The tenter frame equipped with five fields (treatment chambers) has an overall length of 15 meters. The first three treatment chambers are used for drying and the last two for fixing the fabric web. A temperature of approximately 130° C. prevails in the drying chambers and a temperature of 180° C. in the fixing chambers.

4000 $m^3/h$ of waste gas at a temperature of around 110° C. are removed as the first component waste gas stream 16. This first component waste gas stream is cooled to around 30° C. in the condenser 9 and reheated to around 100° C. in the heat exchanger 11.

1000 $m^3/h$ of waste gas at a temperature of around 180° C. are removed from the chamber 6 as the second component waste gas stream. This component waste gas stream is heated to around 750° C. in the combustion chamber 15, cooled to around 300° C. in the heat exchanger 14 and further cooled to around 140° C. in the heat exchanger 11.

The above mentioned quantity of the second component waste gas stream 17 of 1000 $m^3/h$ corresponds to a value of approximately 1.3 $m^3$ per kg of fabric, which is less than one fifth of the quantities of waste gas released into the atmosphere in conventional processes.

Figure 2:
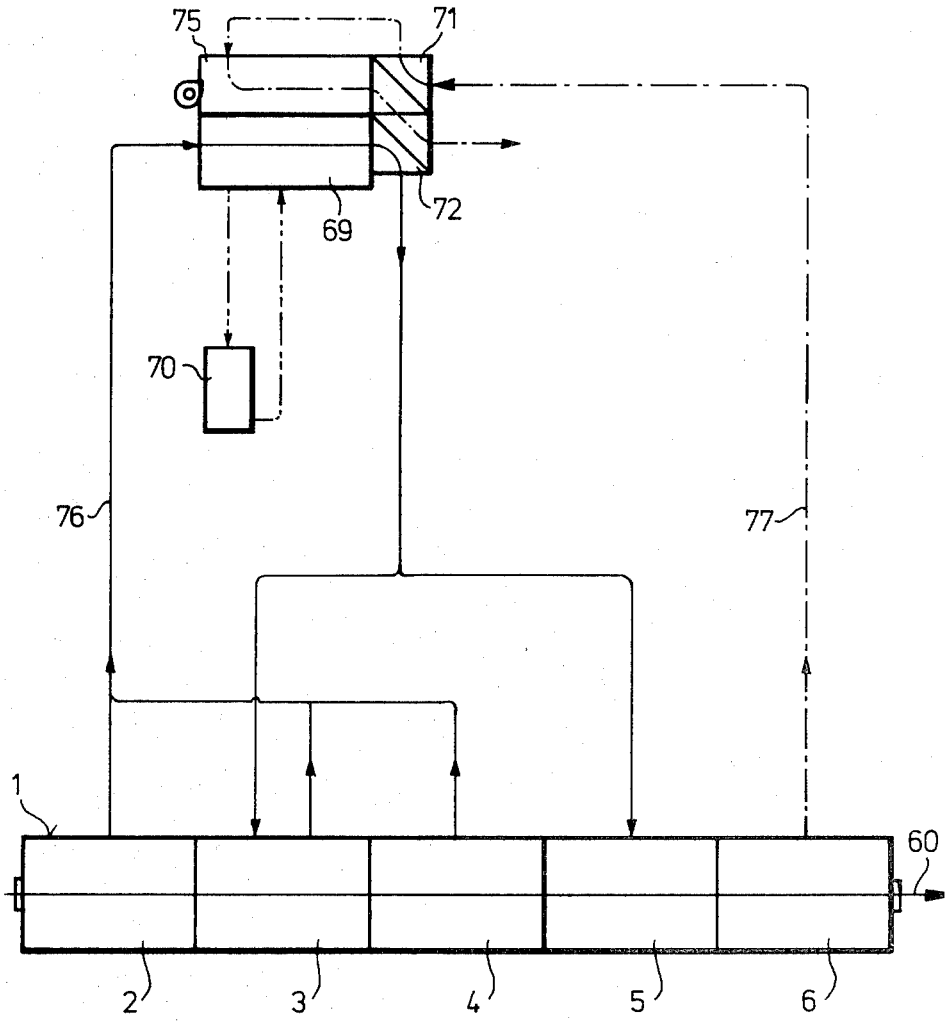
FIG. 2 is a schematic diagram of another installation for performing the process of the present invention.

A second example of embodiment of an installation for carrying out the process according to the invention is illustrated in FIG. 2.

For heat treating and, in particular, for drying and fixing a continuously moved fabric web 60, a tenter frame 1 is provided, comprising three treatment chambers 2, 3 and 4 for drying and two treatment chambers 5 and 6 for fixing the fabric web 60.

The installation further comprises a spray condenser 69 which is connected to a cooling tower 70 used for recooling the cooling water.

The installation further comprises two heat exchangers 71 and 72 and a combustion unit 75.

A first component waste gas stream 76 is removed from the chambers 2 to 4 of the tenter frame 1. The condensible constituents present therein, primarily steam, are condensed in the condenser 69. This first component waste gas stream 76 is then reheated in the heat exchanger 72, after which it passes back into the tenter frame (in the embodiment illustrated into the drying chamber 3 and the fixing chamber 5).

A second component waste gas stream 77 is removed from the fixing chamber 6. It initially passes through the heat exchanger 71, then through the combustion unit 75, back through the heater exchanger 71, then through the heat exchanger 72 and is finally released into the atmosphere. In the combustion unit 75, this second component waste gas stream 77 is freed from the pollutants present in it (particularly organic substances which evaporate from the fabric web 60 in the fixing zone).

The second component waste gas stream heated by combustion is used first (in the heat exchanger 71) for preheating the second component waste gas stream delivered to the combustion unit and then (in the heat exchanger 72) for reheating the first component waste gas stream.

The following temperatures for example may be encountered in the operation of an installation such as this:

The first component waste gas stream 76 is removed from the drying chambers at a temperature of around 120° C. In the spray condenser 69, the temperature of this first component waste gas stream falls to around 30° C. This first component waste gas stream 76 is then reheated to around 185° C. in the heat exchanger 72.

The second component waste gas stream 77 issues from the fixing chamber 6 at a temperature of, for example, around 150° C. This component waste gas stream is heated to a temperature of around 450° C. in the heat exchanger 71. A temperature of from 700° to 750° C. is adjusted in the combustion unit 75 (by regulating the supply of fuel accordingly). The waste gases from this combustion unit are then cooled in the heat exchangers 71 and 72 to a temperature of around 200° C. with which they are released into the atmosphere.

We claim:

1. In a process for heat treating a fabric web to be dried and fixed wherein the web is moved through a treatment unit to pass successively through a drying zone and then through a fixing zone, said web being exposed to a hot gas stream circulated through said unit;

the improvement comprising the steps of removing gas from each of said drying and fixing zones in separate respective first and second component waste gas streams, condensing condensible constituents in the first gas stream, burning combustible constituents in the second gas stream,, reheating the first gas stream following the condensing step by transfer of heat from the second gas stream, and discharging the second stream to atmosphere following the reheating of the first gas stream.

2. A process as claimed in claim 1 characterized in that the first gas stream freed from the condensible constituents is introduced into both treatment zones.

3. A process as claimed in claim 1 characterized in that between the step of burning and the step of heat transfer to the first gas stream, said second gas stream heats a fluid heat carrier in the treatment unit.

4. A process according to claim 1 characterized by preheating said second gas stream prior to the burning step.

5. A process according to claim 4 characterized in that said preheating is effected by a portion of said second gas stream following the burning of constituents therein.

6. A process as claimed in claim 4 characterized in that the second waste gas stream is preheated to between about 400° C. and about 450° C.

7. A process as claimed in claim 1 characterized in that a spray condenser is used for condensing the condensible constituents present in the first gas stream.

* * * * *